US007480213B2

(12) United States Patent
Muraji

(10) Patent No.: US 7,480,213 B2
(45) Date of Patent: Jan. 20, 2009

(54) TIMEPIECE

(75) Inventor: Toyonori Muraji, Tokyo (JP)

(73) Assignee: Seiko Clock Inc., Tokyo (JP)

( * ) Notice: Subject to any disclaimer, the term of this patent is extended or adjusted under 35 U.S.C. 154(b) by 0 days.

(21) Appl. No.: 11/806,043

(22) Filed: May 29, 2007

(65) Prior Publication Data

US 2007/0277578 A1 Dec. 6, 2007

(30) Foreign Application Priority Data

May 31, 2006 (JP) ..... 2006-152566

(51) Int. Cl.
*G04B 19/04* (2006.01)
*G04B 19/00* (2006.01)
*G04B 47/04* (2006.01)

(52) U.S. Cl. ..... 368/223; 368/228; 368/229; 368/285

(58) Field of Classification Search ..... 368/75, 368/88, 223, 272–273, 232, 244, 285, 228–229
See application file for complete search history.

(56) References Cited

U.S. PATENT DOCUMENTS 4,941,137 A * 7/1990 Kikuchi ..... 368/223
D323,464 S * 1/1992 Yamada et al. ..... D10/21
5,161,130 A * 11/1992 Sato et al. ..... 368/228
6,229,768 B1 * 5/2001 Nakazawa et al. ..... 368/223
7,339,855 B2 * 3/2008 Muraji et al. ..... 368/223
2003/0235118 A1 * 12/2003 Lai ..... 368/223

FOREIGN PATENT DOCUMENTS

JP A-04-259889 9/1992
JP A-2000-111667 4/2000
JP 2001153971 A * 6/2001
JP B2 3561669 6/2004

* cited by examiner

*Primary Examiner*—Vit W Miska
*Assistant Examiner*—Sean Kayes
(74) *Attorney, Agent, or Firm*—Oliff & Berridge PLC

(57) ABSTRACT

A mechanical timepiece has a plurality of divisional segments divided in a movable manner, a driving source operable to produce a driving rotation for moving the divisional segments, an ornamental portion to be exposed by outward movement of the divisional segments, and a plurality of driving mechanisms operable to move the divisional segments and rotate them about their axes so as to change an exposure state of the ornamental portion by using the driving rotation transmitted from the driving source.

9 Claims, 14 Drawing Sheets

TIMEPIECE

BACKGROUND OF THE INVENTION

1. Field of the Invention

The present invention relates to a timepiece, and more particularly, to a mechanical timepiece such as a marionette clock.

2. Description of the Related Art

Heretobefore, there has been known a mechanical clock such as a marionette clock having a dial formed by a plurality of divisional segments that are rotated about their own axes, for example, on the hour so as to expose an ornamental member located behind the divisional segments (see Japanese Patent No. 3561669).

Furthermore, there has been known a mechanical clock capable of moving a plurality of divisional segments outward so as to expose an ornamental member behind the divisional segments.

However, since the mechanical clock disclosed by Japanese Patent No. 3561669 merely rotates the divisional segments about their axes to expose the ornamental member, it cannot sufficiently present a wide variety of appearances.

Furthermore, in the case of the mechanical clock that can move a plurality of divisional segments outward so as to expose the ornamental member, a range of the outward movement of the divisional segments should be widened in order to increase an exposed area of the ornamental member. Accordingly, the clock cannot be made compact in size.

SUMMARY OF THE INVENTION

It is, therefore, an object of the present invention to provide a compact timepiece capable of presenting a wide variety of appearances and having excellent decorative design with a reduced number of parts.

The above object is attained by a mechanical timepiece having a plurality of divisional segments divided in a movable manner, a driving source operable to produce a driving rotation for moving the divisional segments, an ornamental portion to be exposed by outward movement of the divisional segments, and a plurality of driving mechanisms operable to move the corresponding divisional segments and rotate them about their axes so as to change an exposure state of the ornamental portion by using the driving rotation transmitted from the driving source.

With the above arrangement, it is possible to provide a mechanical timepiece capable of presenting a wide variety of appearances and having excellent decorative design by changing an exposure state of the ornamental portion. Furthermore, even if the movable divisional segments are moved outward by a slight distance, an exposure ratio of the ornamental portion can be varied to a large extent by rotation of the movable divisional segments. Accordingly, it is possible to provide a compact mechanical clock having high decorative effects.

Furthermore, the plurality of divisional segments may form a dial with at least four divisional segments radially divided around a predetermined point. The driving mechanisms may be operable to hold the divisional segments so that an outer shape of the plurality of divisional segments is in the form of a rhombus. With this arrangement, an exposure state of the ornamental portion is changed, and the outer shape of the plurality of divisional segments is held in the form of a rhombus. Accordingly, it is possible to provide a mechanical timepiece capable of performing surprising movements and having excellent decorative design.

Moreover, the plurality of divisional segments may form a dial with at least three divisional segments radially divided around a predetermined point. The driving mechanisms may be operable to hold the divisional segments so that an outer shape of the plurality of divisional segments is in the form of a windmill. With this arrangement, an exposure state of the ornamental portion is changed, and the outer shape of the plurality of divisional segments is held in the form of a windmill. Accordingly, it is possible to provide a mechanical timepiece capable of presenting a wide variety of appearances and having excellent decorative design.

Additionally, the driving mechanisms may be operable to swing the divisional segments at predetermined positions. With this arrangement, it is possible to provide a mechanical timepiece capable of presenting a wide variety of appearances and having excellent decorative design.

Furthermore, the driving mechanisms may be operable to move the corresponding divisional segments outward to predetermined positions and then rotate them about their axes at the predetermined positions. With this arrangement, it is possible to vary an exposure ratio of the ornamental portion.

Moreover, each of the plurality of driving mechanisms may include a rotatable member having an output pin for outputting the driving rotation from the driving source, a rotatable stage having a slide guide portion and an arcuate groove formed along a predetermined range of a path of the output pin engaging with the arcuate groove, and a slide plate to which the corresponding divisional segment is attached. The output pin is located at a position deviated from a center of rotation of the rotatable member. The rotatable stage is rotatable concentrically with the rotatable member in cooperation with the output pin moving beyond the predetermined range of the path. The slide plate includes an allowance groove for allowing the output pin engaging with the allowance groove to move in a first direction and a slide guide groove for guiding the slide plate in a second direction different than the first direction with respect to the rotatable stage having the slide guide portion engaging with the slide guide groove. The slide plate is configured to slide in the second direction in cooperation with the output pin moving within the predetermined range of the path and to rotate in cooperation with rotation of the rotatable stage.

With the above arrangement, the divisional segment can be moved in inward and outward directions and rotated about their axes by rotation of the rotatable member. Furthermore, it is possible to simplify parts required for a mechanical clock.

Furthermore, each of the plurality of driving mechanisms may further include a biasing member configured to apply a biasing force to the rotatable stage in a direction opposite to a direction of rotation transmitted from the output pin in order to return the rotatable stage into an initial position. With this arrangement, the rotatable stage can readily be returned to the initial position.

Moreover, the biasing force applied to the rotatable stage by the biasing member may be set at an optimum value for each rotatable stage. With this arrangement, the rotatable stage can readily be returned to the initial position by an optimal biasing force.

Furthermore, each of the plurality of driving mechanisms may further include a positional regulator for regulating an initial position of the rotatable stage in a range of rotation. With this arrangement, it is possible to adjust the amount of rotation of the rotatable stage.

According to the present invention, it is possible to provide a compact mechanical timepiece capable of presenting a wide variety of appearances and having excellent decorative design with a reduced number of parts.

The above and other objects, features, and advantages of the present invention will be apparent from the following description when taken in conjunction with the accompanying drawings which illustrate preferred embodiments of the present invention by way of example.

DETAILED DESCRIPTION OF THE PREFERRED EMBODIMENTS

A mechanical timepiece according to an embodiment of the present invention will be described below with reference to FIGS. 1 to 13F. In the following embodiment, the mechanical timepiece is represented as a mechanical clock. However, the present invention is applicable to any type of mechanical timepieces.

Figure 1:
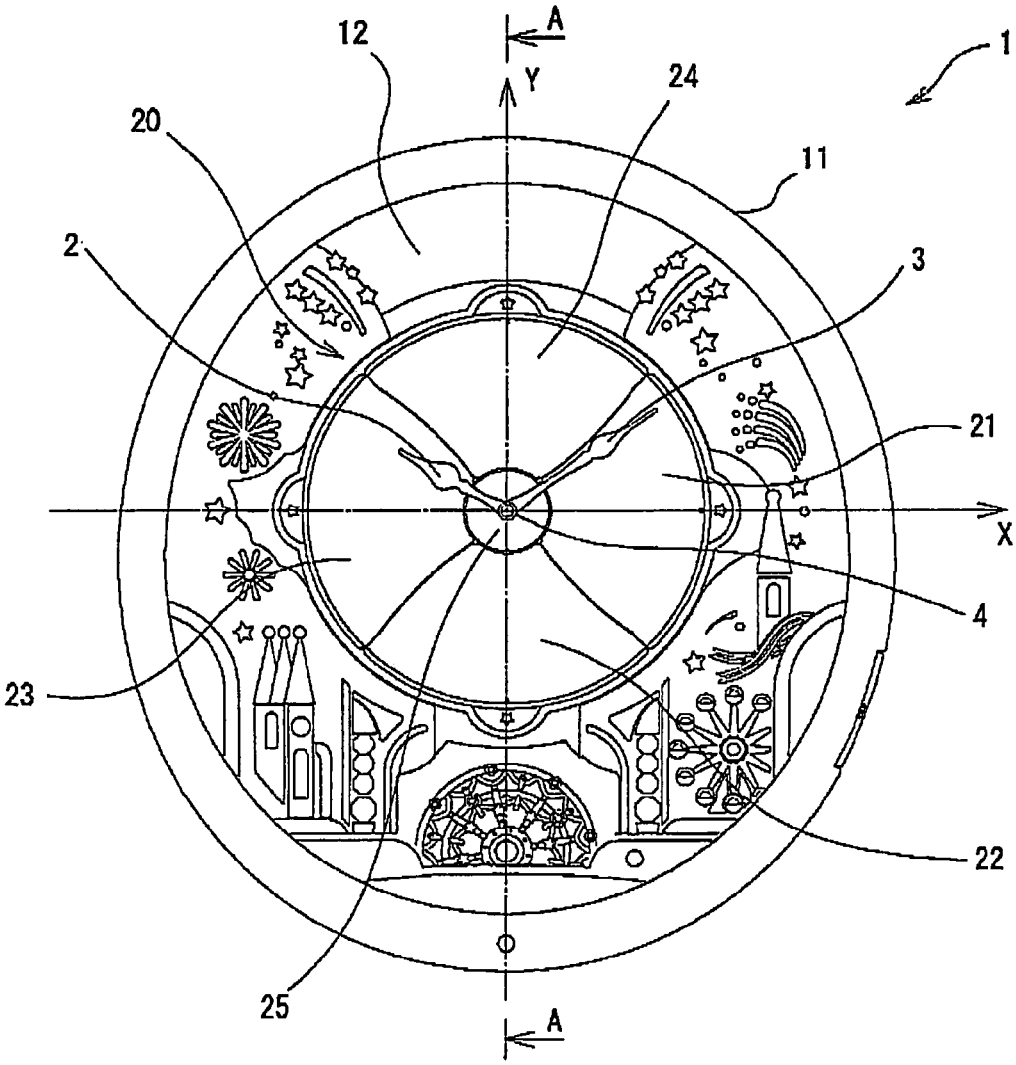
FIG. 1 is a front view showing a mechanical timepiece (mechanical clock) according to an embodiment of the present invention.
Figure 2:
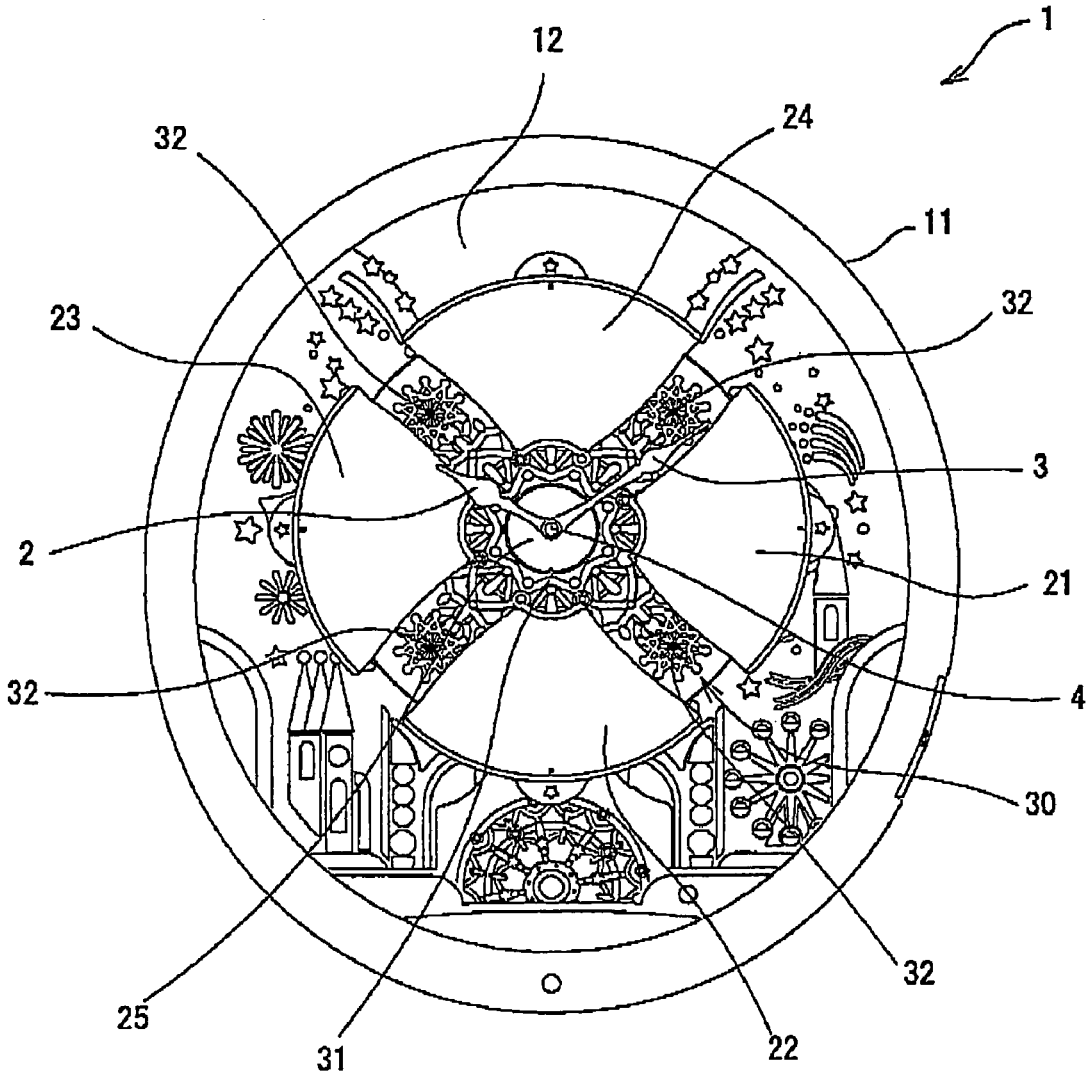
FIG. 2 is a front view showing that ornamental members are partially exposed when movable divisional segments are moved outward.
Figure 3:
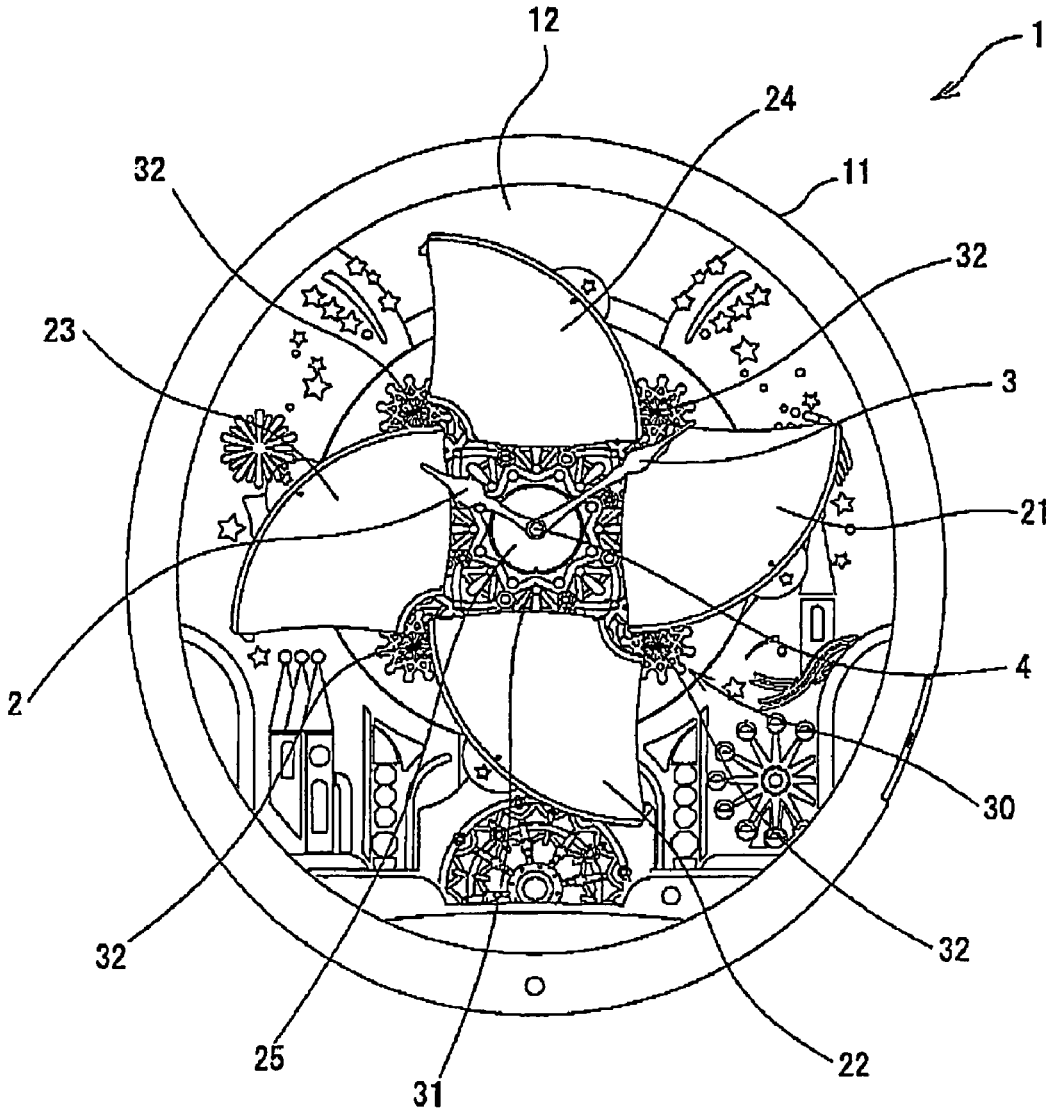
FIG. 3 is a front view showing that the movable divisional segments moved outward are rotated about their axes through 45°.
Figure 4:
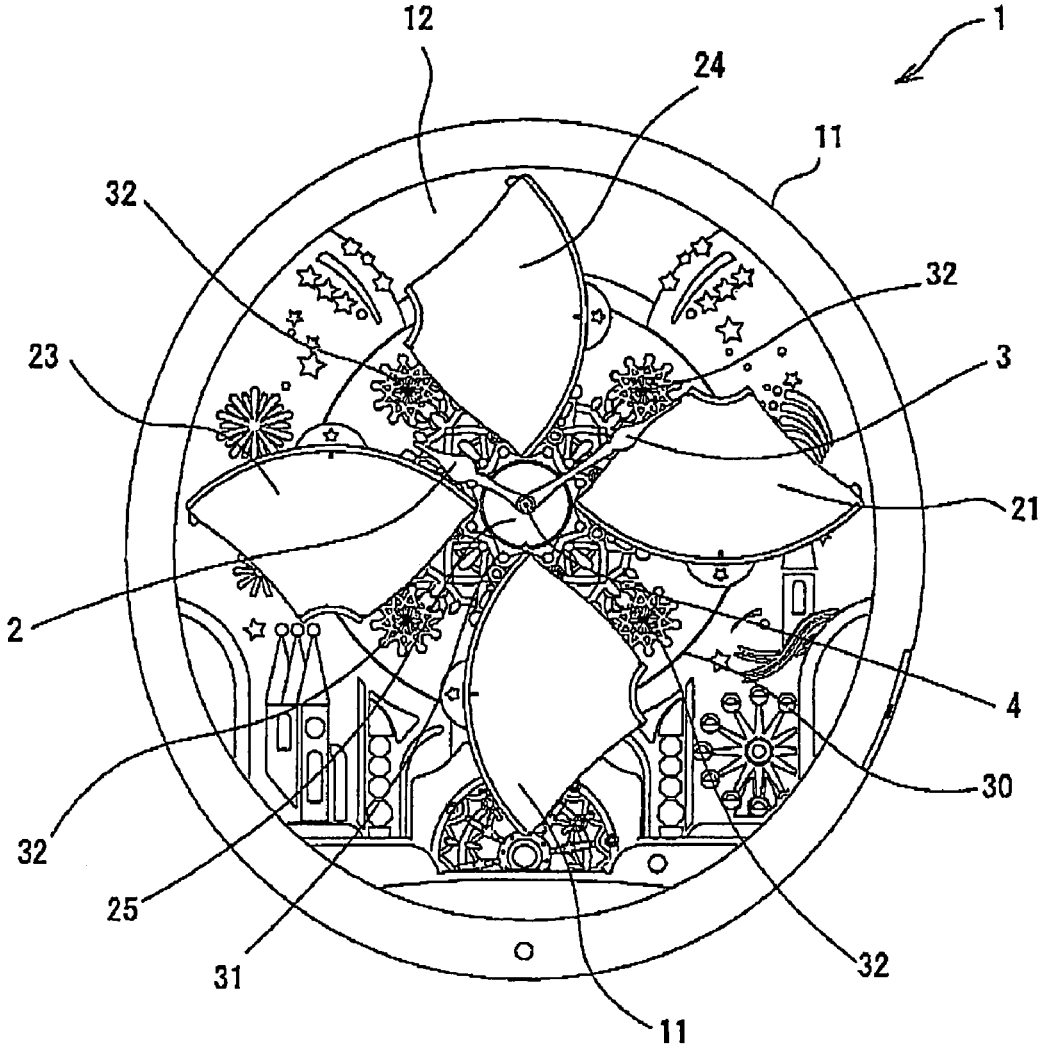
FIG. 4 is a front view showing that the movable divisional segments moved outward are rotated about their axes through 90°.
Figure 5:
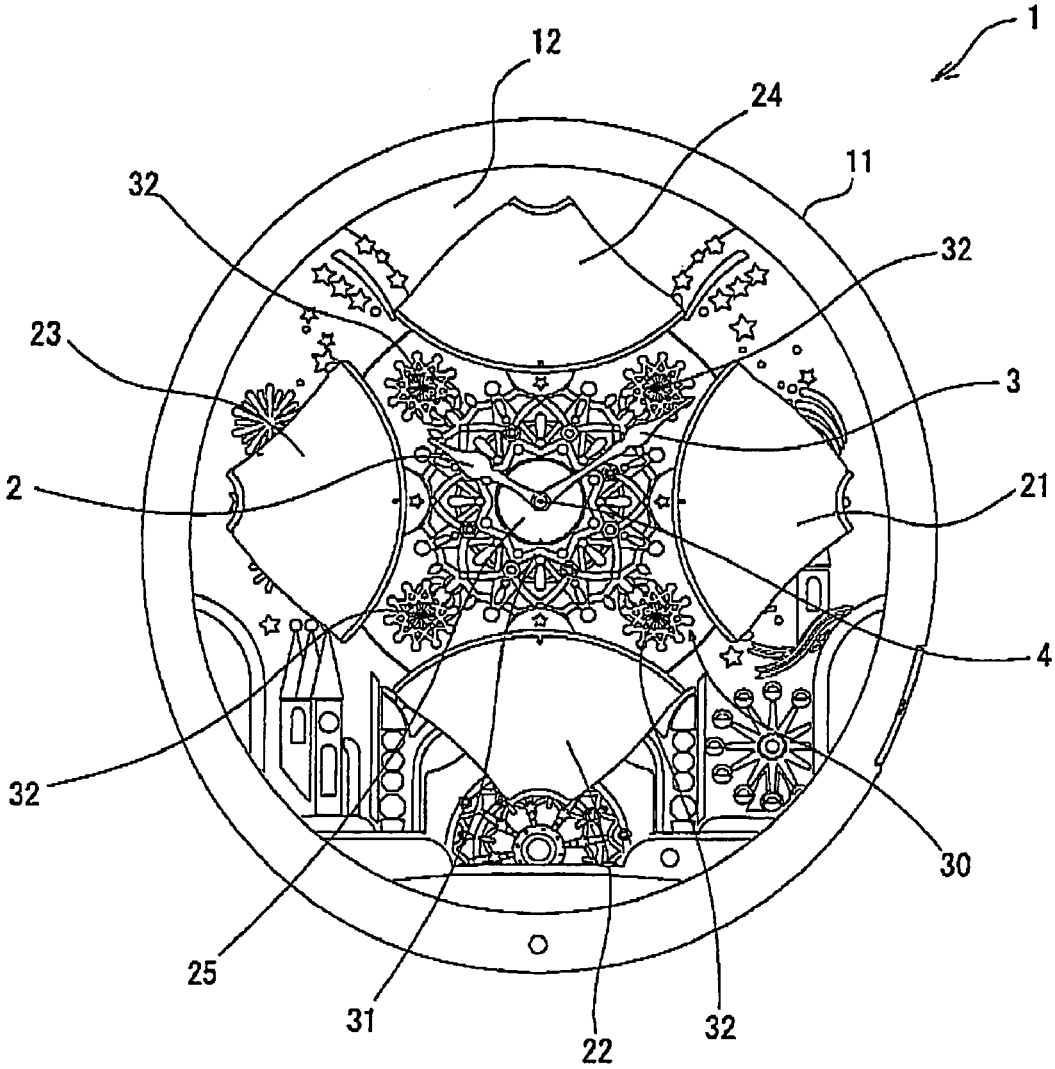
FIG. 5 is a front view showing that the movable divisional segments moved outward are rotated about their axes through 180°.
Figure 6:
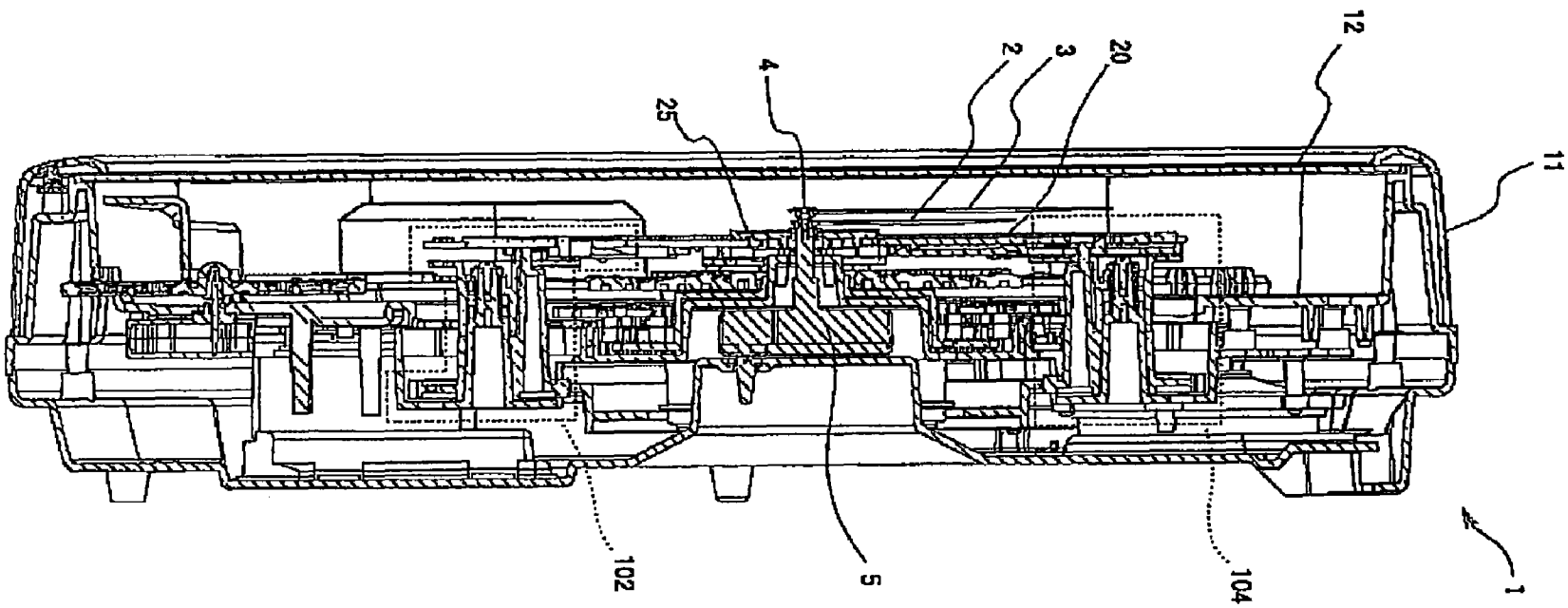
FIG. 6 is a cross-sectional view taken along line A-A of FIG. 1.

FIGS. 1 to 5 show a marionette clock that is one of the mechanical clocks according to an embodiment of the present invention. FIG. 1 is a front view of the mechanical clock. FIG. 2 is a front view showing that ornamental members are partially exposed when movable divisional segments are moved outward as described later. FIG. 3 is a front view showing that the movable divisional segments moved outward are rotated about their axes through 45°. FIG. 4 is a front view showing that the movable divisional segments moved outward are rotated about their axes through 90°. FIG. 5 is a front view showing that the movable divisional segments moved outward are rotated about their axes through 180°. FIG. 6 is a cross-sectional view taken along line A-A of FIG. 1.

A mechanical clock 1 in the present embodiment includes a frame 11 defining an outer edge of the clock 1, a glass 12 covering the front of the frame 11, a hour hand 2 and a minute hand 3 for representing the present time, a rotation shaft 4 for the hour hand 2 and the minute hand 3, a movement 5 for driving the hour hand 2, the minute hand 3, and the like, a circular dial 20, an ornamental portion 30 located behind the circular dial 20, and driving mechanisms 101 to 104 located behind the ornamental portion 30. The circular dial 20 is divided into four movable divisional segments (a plurality of divisional segments) 21 to 24 each having a sectorial shape and a fixed divisional segment 25 having a circular shape. The movable divisional segments are radially divided at equal angles. The fixed divisional segment 25 is disposed around the rotation shaft 4. The ornamental portion 30 is exposed when the movable divisional segments 21 to 24 are moved outward and rotated. The driving mechanisms 101 to 104 are operable to move the movable divisional segments 21 to 24 in inward and outward directions and rotate them about their axes. The ornamental portion 30 is exposed by the outward movement of the movable divisional segments 21 to 24.

The ornamental portion 30 includes a first ornamental member 31 disposed so as to surround the rotation shaft 4 and second ornamental members 32 arranged at equal angles of 90° around the first ornamental member 31.

FIG. 6 shows only two driving mechanisms 102 and 104 operable to drive the movable divisional segments 22 and 24, respectively. Furthermore, numerals printed on the dial 20 are not illustrated in FIGS. 1 to 5.

As shown in FIG. 1, the movable divisional segments 21 to 24 are located at a closed position in a normal state so as not to expose the ornamental portion 30.

At a certain time, as shown in FIG. 2, the movable divisional segments 21 to 24 are moved radially on an X-Y plane that has a point of origin at the center of the rotation shaft 4 and is perpendicular to the rotation shaft 4, and thus separated from the fixed divisional segment 25. Specifically, the movable divisional segment 21 is moved in the rightward direction (X+) on the X-Y plane, and the movable divisional segment 22 is moved in the downward direction (Y−). A movable divisional segment 23 is moved in the leftward direction (X−), and the movable divisional segment 24 is moved in an upward direction (Y+). When the movable divisional segments 21 to 24 are moved outward to predetermined positions, only a portion of the ornamental portion 30 located behind the movable divisional segments 21 to 24 is exposed. More specifically, when the movable divisional segments 21 to 24 are moved radially outward, the first ornamental member 31 is partially exposed while the second ornamental members 32 are exposed between adjacent movable divisional segments. The first ornamental member 31 and the second ornamental members 32 are configured to rotate. Thus, the ornamental portion 30 is exposed approximately in the form of an X.

Then, when the movable divisional segments 21 to 24 are moved outward to the predetermined positions, they start to rotate clockwise about their axes at the predetermined positions. As shown in FIG. 3, when the movable divisional segments 21 to 24 are rotated clockwise through 45°, they are held such that an outer shape of the whole of the movable divisional segments 21 to 24 is in the form a windmill. Specifically, the movable divisional segments 21 to 24 are held such that an outer shape of the movable divisional segments 21 to 24 that is formed by some of their edges other than edges opposed to each other is in the form of a windmill. Furthermore, the first ornamental member 31 is exposed approximately in the form of a square by the edges of the movable divisional segments 21 to 24 facing the fixed divisional segment 25.

Next, as shown in FIG. 4, the movable divisional segments 21 to 24 are rotated clockwise about their axes through 90°.

The movable divisional segments 21 and 23 are opposed to each other so as to face in different directions while the fixed divisional segment 25 is interposed between the movable divisional segments 21 and 23. The movable divisional segments 22 and 24 are also opposed to each other so as to face in different directions while the fixed divisional segment 25 is interposed between the movable divisional segments 22 and 24. At that time, the ornamental portion 30 is exposed approximately in the form of an X. The movable divisional segments 21 to 24 are swung about the axes in the state shown in FIG. 4 for a certain period of time.

Then, as shown in FIG. 5, the movable divisional segments 21 to 24 are rotated clockwise about their axes through 180°. The ornamental portion 30 is exposed to a large extent by this rotation. Thus, almost all areas of the first ornamental member 31 and the second ornamental members 32 are exposed. Furthermore, an outer shape of the whole of the movable divisional segments 21 to 24 is held in the form of a rhombus. Specifically, the movable divisional segments 21 to 24 are held such that an outer shape of the movable divisional segments 21 to 24 that is formed by some of their edges other than edges opposed to each other is in the form of a rhombus. The movable divisional segments 21 to 24 are swung in the state shown in FIG. 5 for a certain period of time.

As described above, an exposure state of the ornamental portion 30 is changed by the movement and rotation of the movable divisional segments 21 to 24.

Now, the driving mechanisms for driving the movable divisional segments will be described.

Figure 7:
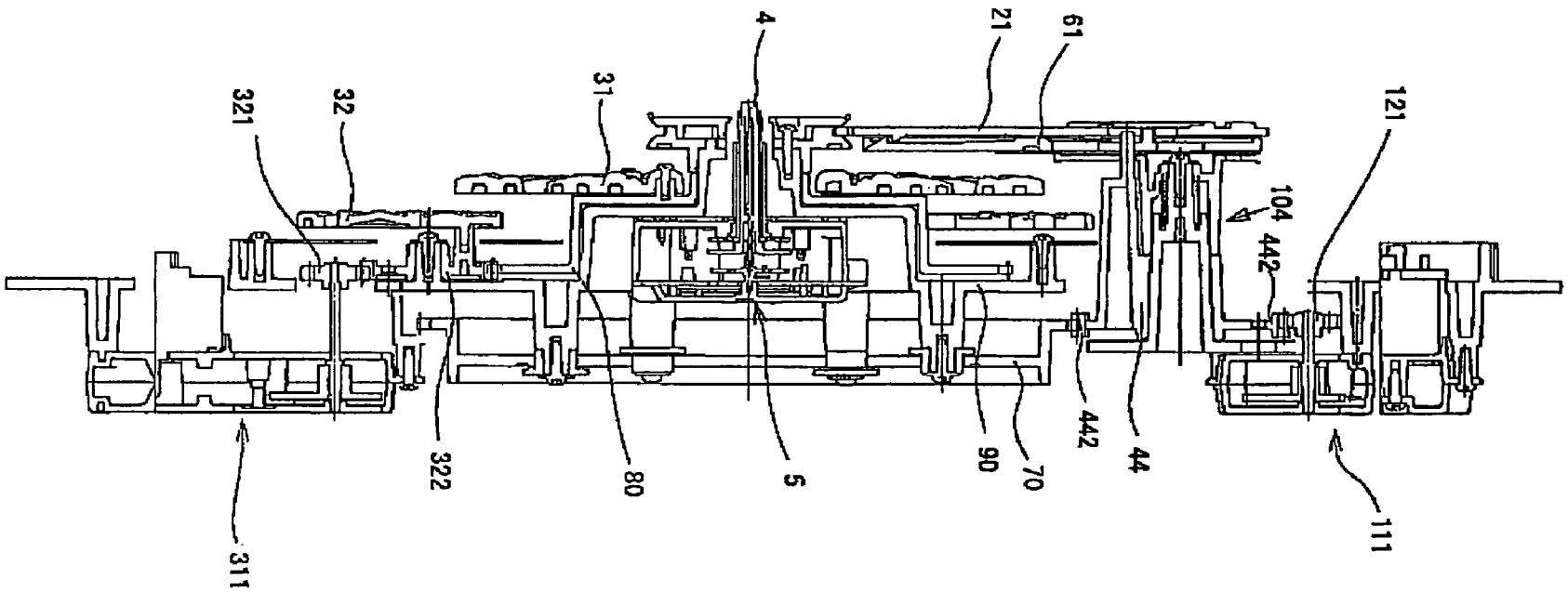
FIG. 7 is a cross-sectional view explanatory of driving rotation transmitted to one of driving mechanisms.

FIG. 7 is a cross-sectional view explanatory of driving rotation transmitted to the driving mechanism 104. As shown in FIG. 7, a dial motor block (driving source) 111 is disposed behind the driving mechanism 104 for moving the movable divisional segments 21 to 24 in the inward and outward directions. The driving mechanism 104 includes a rotatable member 44 having a gear portion 442 formed on an outer circumferential surface of the rotatable member 44. The dial motor block 111 rotates a driving pinion 121 engaging with the gear portion 442 of the rotatable member 44. Thus, the rotatable member 44 is driven and rotated by the driving pinion 121. Furthermore, an idler gear 70 is disposed behind the movement 5 and the ornamental portion 30, and the gear portion 442 of the rotatable member 44 engages with the idler gear 70. Accordingly, the idler gear 70 is driven and rotated by the rotatable member 44 of the driving mechanism 104.

In addition to the rotatable member 44, other rotatable members are provided around the idler gear 70 in the driving mechanisms for driving the movable divisional segments 21 to 23. Although not shown in FIG. 7, the idler gear 70 engages with gear portions formed on outer circumferential surfaces of the rotatable members provided in the driving mechanisms for driving the movable divisional segments 21 to 23. Those rotatable members are driven and rotated by rotation of the idler gear 70.

In this manner, the driving rotation of the dial motor block 111 is transmitted to the rotatable member 44 of the driving mechanism 104, then transmitted from the rotatable member 44 to the idler gear 70, and transmitted from the idler gear 70 to the rotatable members provided in the driving mechanisms for driving the movable divisional segments 21 to 23. With this configuration, a plurality of movable divisional segments can be driven by a single driving source.

As described above, the mechanical clock 1 in the present embodiment has the driving mechanisms for moving the movable divisional segments 21 to 24 in the inward and outward directions and rotating them with use of the driving rotation transmitted from the dial motor block 111 so as to change an exposure state of the ornamental portion 30.

This arrangement can provide a mechanical clock capable of presenting a wide variety of appearances and having excellent decorative design by changing an exposure state of the ornamental portion.

Furthermore, even if the movable divisional segments 21 to 24 are moved outward by a slight distance, an exposure ratio of the ornamental portion 30 can be varied to a large extent by rotation of the movable divisional segments. Accordingly, it is possible to provide a compact mechanical clock having high decorative effects.

Additionally, as shown in FIG. 3, the driving mechanisms are operable to hold a plurality of movable divisional segments 21 to 24 in the form of a windmill. As shown in FIG. 5, the driving mechanisms are operable to hold a plurality of movable divisional segments 21 to 24 in the form of a rhombus. This configuration can provide a mechanical clock capable of presenting a wide variety of appearances and having excellent decorative design.

Moreover, the movable divisional segments 21 to 24 are swung in the states shown in FIGS. 4 and 5. This configuration can provide a mechanical clock capable of presenting a wide variety of appearances and having excellent decorative design.

As shown in FIG. 7, an ornamental member motor block 311 is disposed behind the ornamental portion 30 for driving the ornamental portion 30. The ornamental member motor block 311 rotates a driving pinion 321, which engages with a gear 322 for the second ornamental member 32. The gear 322 is coupled to the second ornamental member 32. Accordingly, the second ornamental member 32 is rotated in cooperation with rotation of the gear 322. Furthermore, the gear 322 for the second ornamental member 32 is rotatable about the rotation shaft 4 and engages with a gear 80 for the first ornamental member 31. The gear 80 has an upper surface to which the first ornamental member 31 is fixed. Thus, the gear 80 for the first ornamental member 31 is driven and rotated by the gear 322 for the second ornamental member 32. Furthermore, the gear 80 for the first ornamental member 31 engages with gears for driving the other second ornamental members.

In this manner, the driving rotation of the ornamental member motor block 311 is transmitted to the gear 322 for the second ornamental member 32, then transmitted from the gear 322 to the gear 80 for the first ornamental member 31, and transmitted from the gear 80 to the gears for the other ornamental members. With this configuration, a plurality of ornamental members can be driven by a single driving source.

Next, the driving mechanisms for moving the movable divisional segments in the inward and outward directions and rotating them about their axes will be described in greater detail.

Figure 8:
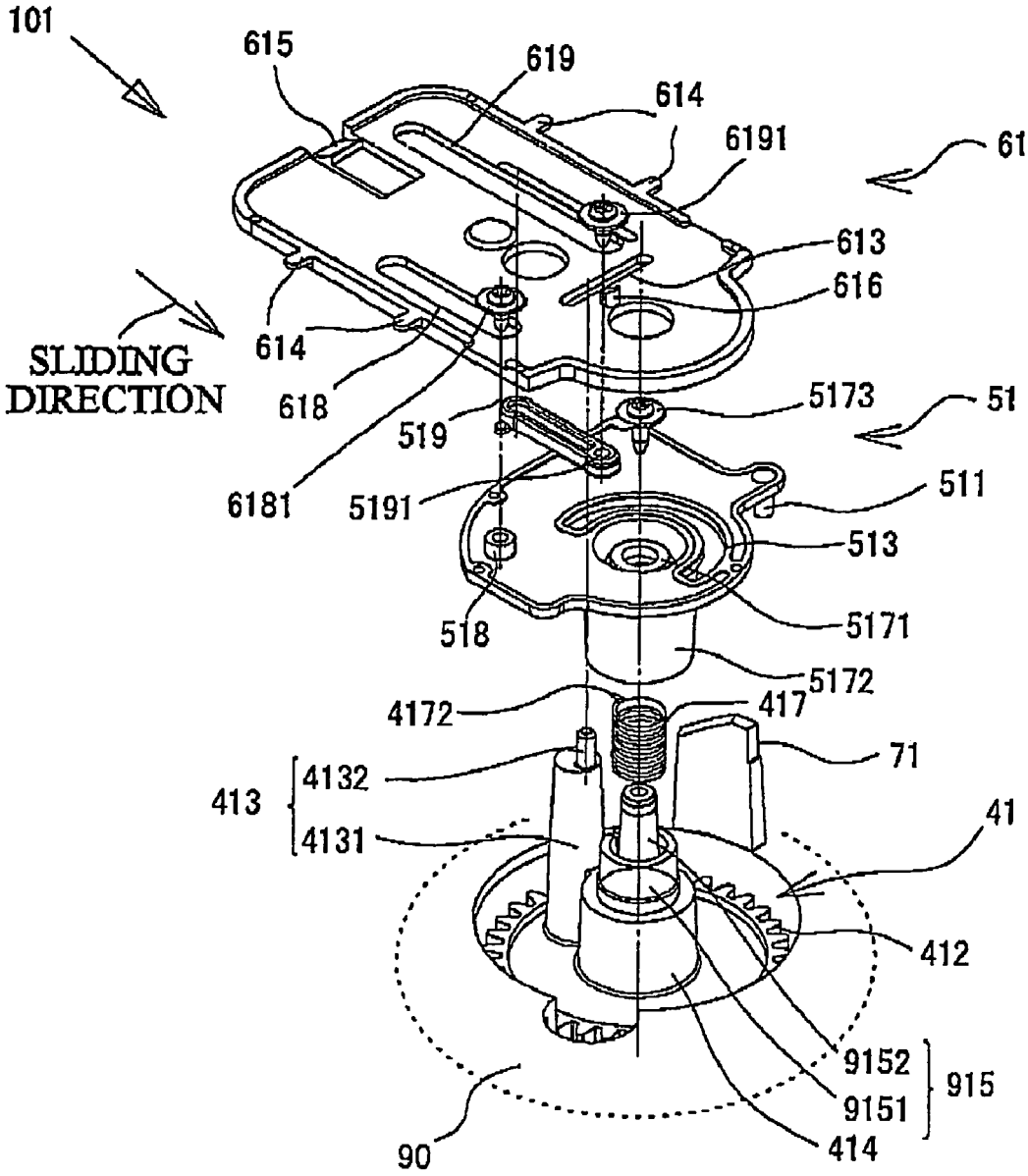
FIG. 8 is an exploded perspective view showing one of the driving mechanisms.

FIG. 8 is an exploded perspective view showing one of the driving mechanisms. The driving mechanism shown in FIG. 8 serves to move the movable divisional segment 21 in the inward and outward directions and rotate it about its axis.

Figure 9A:
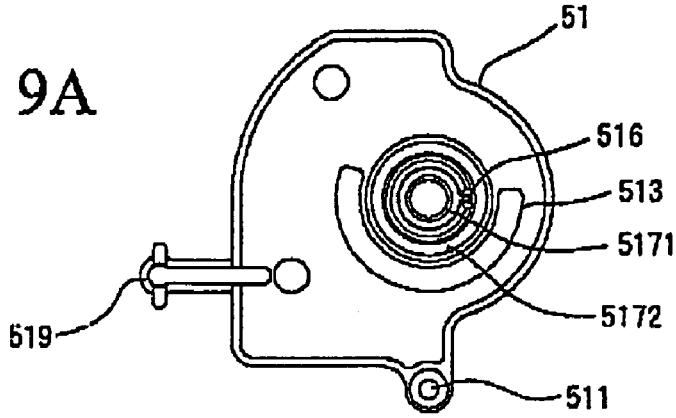
FIGS. 9A to 9D are views showing an arrangement of a rotatable member and a rotatable stage in the driving mechanism shown in FIG. 8.

FIGS. 9A to 9D are views showing an arrangement of a rotatable member and a rotatable stage in the driving mechanism shown in FIG. 8. FIG. 9A is a bottom view of the rotatable stage, FIG. 9B a top view of the rotatable stage attached to the rotatable member, FIG. 9C a cross-sectional view taken along line A-A of FIG. 9B, and 9D a view showing a position of a slit defined in a rotation shaft of a base plate.

Figures 10A, 10B, 10C, 10D:
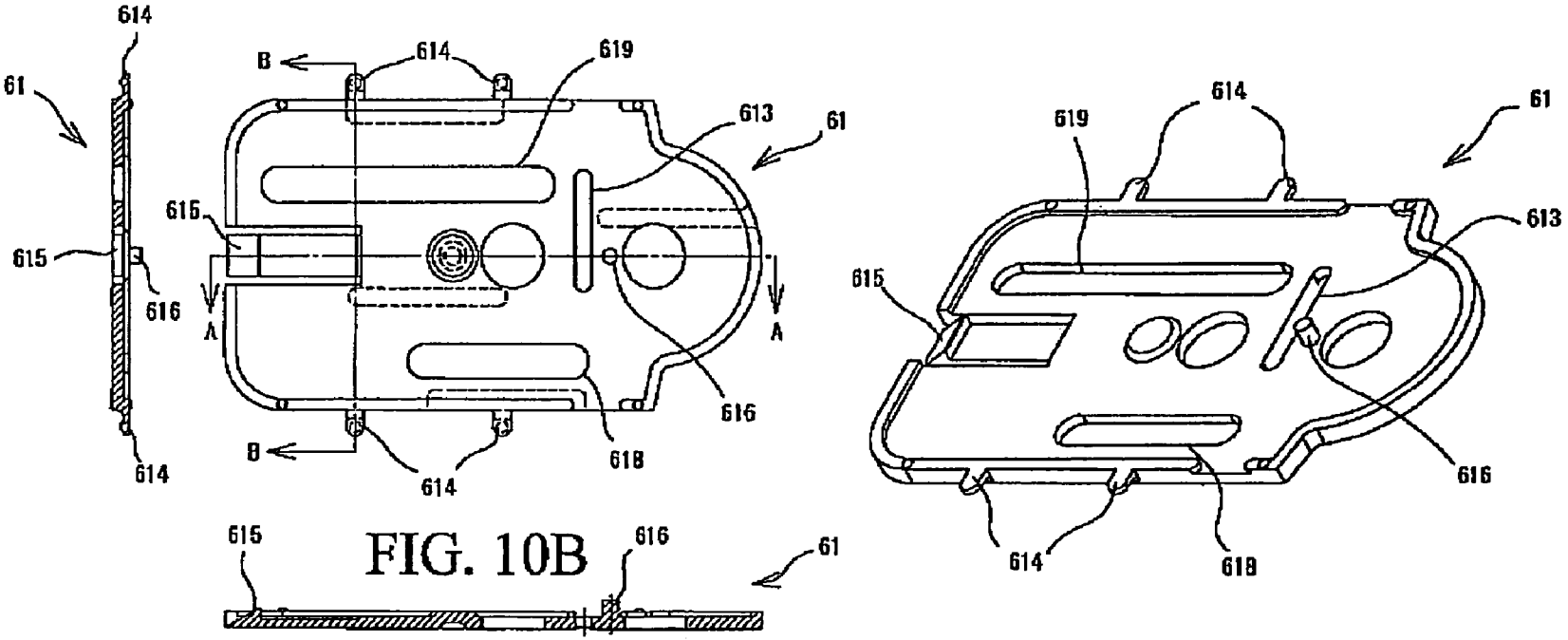
FIGS. 10A to 10D are views showing an arrangement of a slide plate in the driving mechanism shown in FIG. 8.

FIGS. 10A to 10D are views showing an arrangement of a slide plate in the driving mechanism shown in FIG. 8. FIG. 10A is a front view of the slide plate, FIG. 10B a cross-sectional view taken along line A-A of FIG. 10A, FIG. 10C a cross-sectional view taken along line B-B of FIG. 10A, and FIG. 10D a perspective view of the slide plate.

Figure 11D:
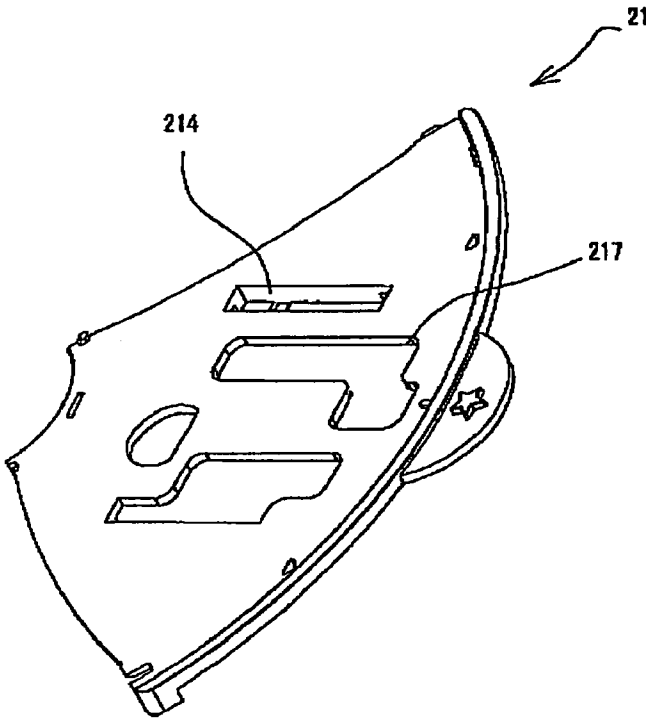
FIGS. 11A to 11D are views showing an arrangement of one of the movable divisional segments.
Figure 11A:
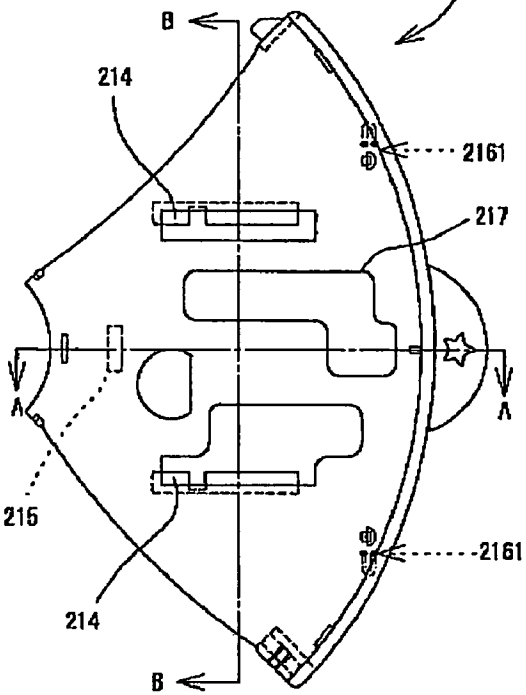
Figure 11B:
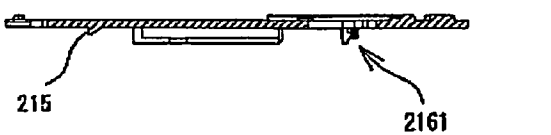
Figure 11C:
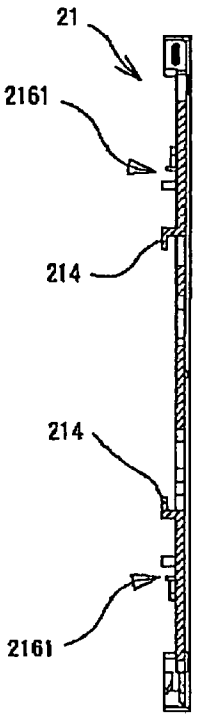

FIGS. 11A to 11D are views showing an arrangement of one of the movable divisional segments. FIG. 11A is a front view of the movable divisional segment, FIG. 11B a cross-sectional view taken along line A-A of FIG. 11A, FIG. 11C a cross-sectional view taken along line B-B of FIG. 11A, and FIG. 11D a perspective view of the movable divisional segment.

Figure 12D:
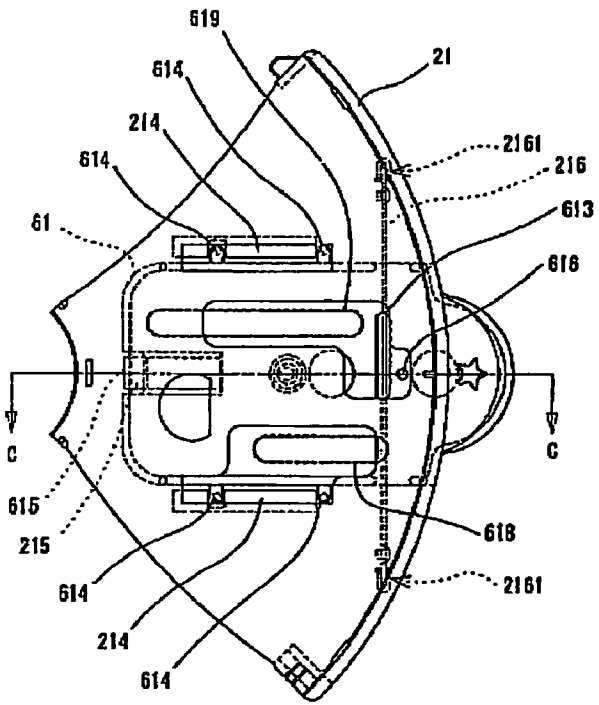
FIGS. 12A to 12E are views showing that the movable divisional segment is attached to the slide plate.
Figure 12E:
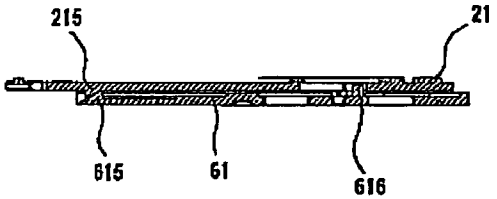
Figure 12A:
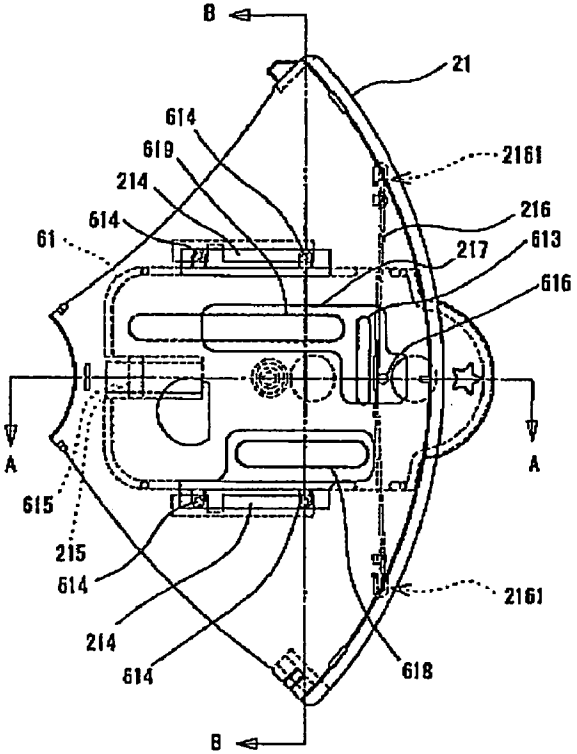

FIGS. 12A to 12E are views showing that the movable divisional segment is attached to the slide plate. FIG. 12A is a front view showing the slide plate and the movable divisional segment at an initial position, FIG. 12B a cross-sectional view taken along line A-A of FIG. 12A, FIG. 12C a cross-sectional view taken along line B-B of FIG. 12A, FIG. 1ZD a front view showing that the slide plate is slightly moved, and FIG. 12E a cross-sectional view taken along line C-C of FIG. 12D.

As shown in FIG. 8, the driving mechanism 101 includes a rotatable member 41, a rotatable stage 51, and a slide plate 61.

First, the rotatable member 41 will be described. As shown in FIGS. 8 and 9C, the rotatable member 41 is held so as to be rotatable about a fixed shaft 915 formed on a base plate 90. The rotatable member 41 is received in a recessed portion formed in the base plate 90.

As described above, the rotatable member 41 has a gear portion 412 formed on an outer circumferential surface thereof. The gear portion 412 engages with the idler gear 70.

The rotatable member 41 also includes an output pin 413 for outputting driving rotation from the dial motor block 111. The output pin 413 is integrally formed at a position deviated from the center of rotation. The output pin 413 extends perpendicular to a rotation direction of the rotatable member 41 and includes a body portion 4131 and a tip portion 4132 extending from the body portion 4131. The tip portion 4132 has a diameter smaller than that of the body portion 4131.

Furthermore, the rotatable member 41 has a bearing holder 414, which is brought into sliding contact with the rotatable stage 51.

The fixed shaft 915 includes a body portion 9151 and a tip portion 9152 extending with a diameter smaller than that of the body portion 9151. The fixed shaft 915 has a space defined in a radial direction between the body portion 9151 and the tip portion 9152 for receiving a torsion spring (biasing member) 417. The torsion spring 417 is received so as to wind around the tip portion 9152. As shown in FIGS: 9C and 9D, the body portion 9151 has a slit 916 defined therein for holding a lower end 4171 of the torsion spring 417 near the rotatable member 41.

Next, the rotatable stage 51 will be described.

The rotatable stage 51 has a through-hole 5171 defined therein, through which the tip portion 9152 of the fixed shaft 915 extends. The tip portion 9152 of the fixed shaft 915 has a thread groove formed therein. While the tip portion 9152 of the fixed shaft 915 penetrates the through-hole 5171, the rotatable stage 51 is held so as to be slidable with respect to the fixed shaft 915 by fitting a screw 5173 into the thread groove of the tip portion 9152.

Furthermore, the rotatable stage 51 includes a cylindrical leg portion 5172 extending in a direction facing to the rotatable member 41. The leg portion 5172 is formed so as to surround the tip portion 9152 and the body portion 9151 of the fixed shaft 915. The leg portion 5172 is brought into sliding contact with the bearing holder 414 of the rotatable member 41. Thus, the rotatable stage 51 is held such that it is maintained at a predetermined height with respect to the rotatable member 41 and can be rotated concentrically with the rotatable member 41.

The rotatable stage 51 has an arcuate groove 513 having a length of a semi-circle. The arcuate groove 513 is formed around the through-hole 5171. The tip portion 4132 of the output pin 413 engages with the arcuate groove 513. Furthermore, the arcuate groove 513 is formed along a predetermined range of a path of the output pin 413 moving in accordance with rotation of the rotatable member 41.

Figure 9B:
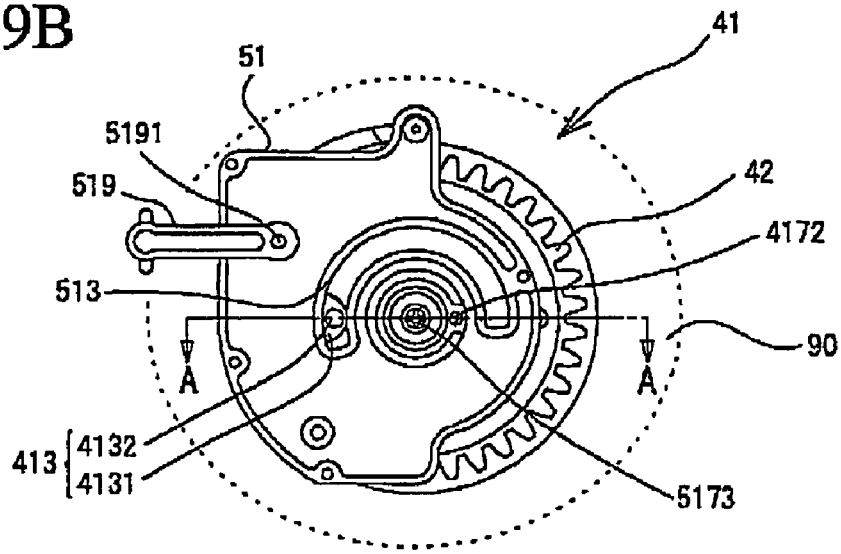
Figure 9C:
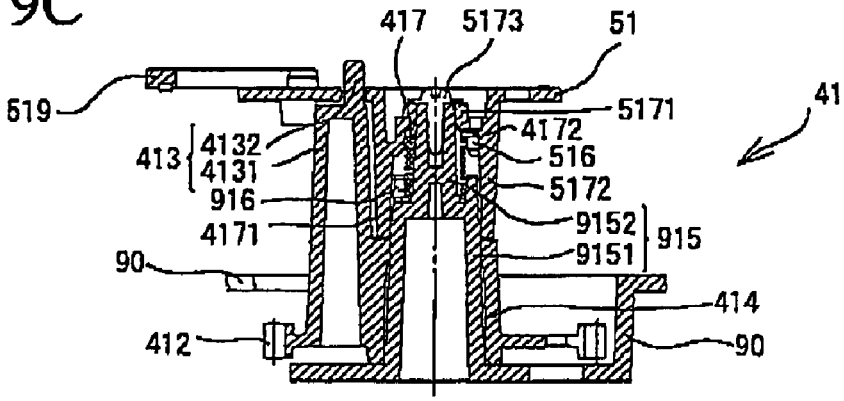
Figure 9D:
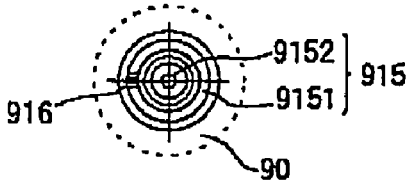

As shown in FIGS. 9A to 9C, the rotatable stage 51 has a slit 516 formed on an inner circumferential surface of the leg portion 5172 for holding an upper end 4172 of the torsion spring 417 near the rotatable stage 51. As shown in FIG. 9C, the slit 516 formed in the rotatable stage 51 and the slit 916 formed in the fixed shaft 915 are positioned with an angle of 180° formed therebetween. The torsion spring 417 is arranged such that both ends of the torsion spring 417 are aligned with the same direction at the natural state. When the torsion spring 417 is fitted into the slits 516 and 916, it is biased toward a direction opposite to the rotation direction of the rotatable stage 51 (clockwise in FIG. 9B), in which rotation is transmitted from the output pin 413. That is, the torsion spring 417 is placed such that the upper end 4172 of the torsion spring 417 is twisted clockwise.

Accordingly, even if the output pin 413 is moved clockwise within the arcuate groove 513, the biasing force allows only the rotatable member 41 to be rotated relative to the rotatable stage 51 with sliding contact between the leg portion 5172 and the bearing holder 414 while the rotatable stage 51 is stationary with respect to the fixed shaft 915.

When the rotatable member 41 is further rotated in a state such that the output pin 413 has been positioned to an end of the arcuate groove 513 by moving the output pin 413 beyond the predetermined range, the rotatable stage 51 starts to rotate in cooperation with the rotatable member 41, the details of which will be described later.

Furthermore, the rotatable stage 51 has a positional regulation pin (positional regulator) 511 projecting toward the base plate 90. The base plate 90 has a positional regulation block (positional regulator) 71 extending toward the rotatable stage 51. The rotation angle of the rotatable stage 51 is regulated by engagement of the positional regulation pin 511 with the positional regulation block 71. The rotatable stage 51 is biased in one direction by the torsion spring 417. Accordingly, the positional regulation pin 511 is brought into contact with the positional regulation block 71 by the bias of the torsion spring 417. The rotatable stage 51 is located at an initial position when the positional regulation pin 511 is brought into contact with the positional regulation block 71. The arcuate groove 513 is formed slightly longer than needed for the initial position to ensure contact between the positional regulation pin 511 and the positional regulation block 71. Therefore, when the positional regulation pin 511 is brought into contact with the positional regulation block 71, a slight gap is formed between the output pin 413 and an end of the arcuate groove 513 at the initial position.

Furthermore, the rotatable stage 51 has a slide guide portion 518 formed on a surface of the rotatable stage 51 facing the slide plate 61 for guiding the slide plate 61 and a slide guide member (slide guide portion) 519 fixed to the rotatable stage 51.

Next, the slide plate 61 will be described. The slide plate 61 holds the movable divisional segment 21 in a movable manner so as to move the movable divisional segment 21 in inward and outward directions.

The slide plate 61 has a first slide guide groove 618 with which the slide guide portion 518 engages and a second slide guide groove 619 with which the slide guide member 519 engages. The first slide guide groove 618 and the second slide guide groove 619 extend in a longitudinal direction of the slide plate 61. A screw 6181 is fitted into a thread groove formed in the slide guide portion 518. A screw 6191 is fitted into a thread groove 5191 formed in the slide guide member 519. The slide plate 61 is attached to the rotatable stage 51 so as to be slidable in a predetermined direction by the screw 6181 and the screw 6191. The slide guide member 519 is a separate member from the rotatable stage 51 and is attached to the rotatable stage 51 by the screw 6191.

Furthermore, the slide plate 61 has an allowance groove 613 formed approximately at the center of the slide plate 61. The allowance groove 613 extends perpendicular to the first slide guide groove 618. The tip portion 4132 of the output pin 413 engages with the allowance groove 613. The allowance groove 613 allows the output pin 413 to move in a predetermined direction. With this configuration, the slide plate 61 slides in cooperation with movement of the output pin 413 within the predetermined range. Additionally, the slide plate 61 rotates in cooperation with rotation of the rotatable stage 51.

The attachment of the movable divisional segment to the slide plate will briefly be described below.

As shown in FIGS. 10A to 10D, the slide plate 61 has a projection 616 formed near the allowance groove 613. Furthermore, the slide plate 61 also has protuberances 614 formed on both of side surfaces for attachment of the movable divisional segment 21.

As shown in FIGS. 11A to 11D and 12A to 12E, the movable divisional segment 21 has rail portions 214 with which the protuberances 614 of the slide plate 61 engages in a slidable manner. Furthermore, the movable divisional segment 21 also has an opening portion 217 formed approximately at a central portion thereof. The projection 616 of the slide plate 61 is received within this opening portion 217. The movable divisional segment 21 includes attachment portions 2161 formed on a surface of the movable divisional segment 21 facing the slide plate 61. Although not shown in FIGS. 11A to 11D, a wire spring 216 is attached to the attachment portions 2161 as shown in FIGS. 12A to 12E. The movable divisional segment 21 is attached to the slide plate 61 so that the projection 616 is located between the wire spring 216 and the opening portion 217.

Figure 12B:
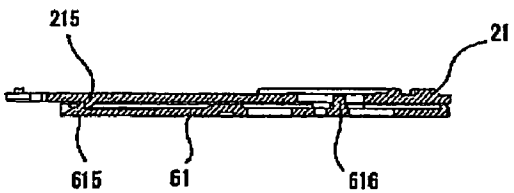
Figure 12C:
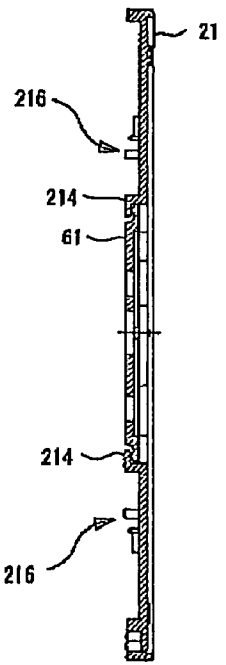

The slide plate 61 has a snap-on hook 615 formed thereon. The movable divisional segment 21 has an abutment portion 215 formed on the surface of the movable divisional segment 21 facing the slide plate 61. The movable divisional segment 21 is positioned with respect to the slide plate 61 by the snap-on hook 615 of the slide plate 61 and the abutment portion 215 of the movable divisional segment 21. FIGS. 12A and 12B show that the slide plate 61 is positioned at the initial position of the movable divisional segment 21 prior to the outward movement by engagement of the snap-on hook 615 and the abutment portion 215 while it is biased toward the rightward direction by the wire spring 216. FIGS. 12D and 12E show a state of the slide plate 61 before the movable divisional segment 21 is attached to the slide plate 61. In this state, the snap-on hook 615 does not engage with the abutment portion 215. FIGS. 12D and 12E show that the slide plate 61 starts to be slid in the leftward direction for attachment to the movable divisional segment 21. When the slide plate 61 is further slid in the leftward direction, the slide plate 61 and the movable divisional segment 21 are positioned with respect to each other as described above.

Now, operation of the driving mechanism 101 will be described in detail.

FIGS. 13A to 13F are transparent views showing sliding and rotation of the slide plate 61. The movable divisional segment is not illustrated in FIGS. 13A to 13F.

Figure 13A:
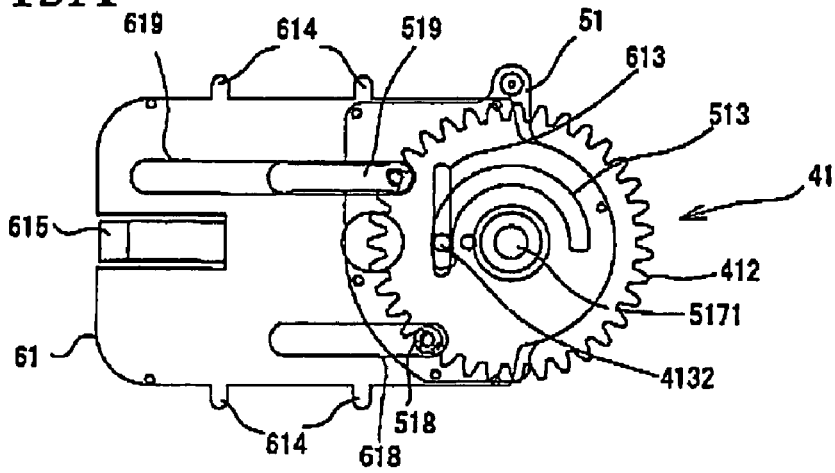
FIGS. 13A to 13F are transparent views showing sliding and rotation of the slide plate.

FIG. 13A shows that the slide plate 61 is held at an initial position. At that time, the movable divisional segment 21 is held at the state shown in FIG. 1. In this state, the tip portion 4132 of the output pin 413 engages with the allowance groove 613 and the arcuate groove 513, thereby rotating the rotatable member 41 clockwise.

Figure 13B:
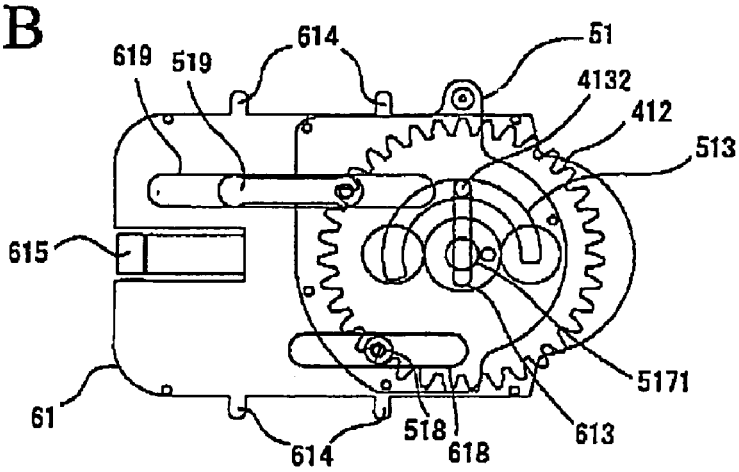

FIG. 13B shows that the rotatable member 41 is rotated clockwise through 90° from the state shown in FIG. 13A. At that time, the tip portion 4132 of the output pin 413 is located at an end of the allowance groove 613 and located at a central portion of the arcuate groove 513. When the output pin 413 is moved to the central portion of the arcuate groove 513, the slide plate 61 is slid in the rightward direction by the tip portion 4132 of the output pin 413. Furthermore, the slide guide portion 518 and the slide guide member 519 regulate a direction in which the slide plate 61 is slid. In this state, the rotatable stage 51 is not rotated.

Figure 13C:
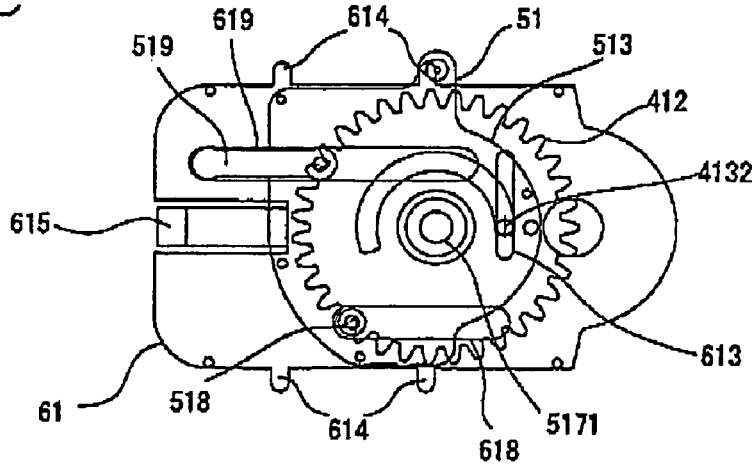

FIG. 13C shows that the rotatable member 41 is further rotated clockwise through 90° from the state shown in FIG. 13B. At that time, the tip portion 4132 of the output pin 413 is located at an end of the arcuate groove 513. The slide plate 61 is further slid in the rightward direction from the state shown in FIG. 13B by the movement of the output pin 413. The movable divisional segment 21 is held at the state shown in FIG. 2. In this state, the rotatable stage 51 is not rotated.

Figure 13D:
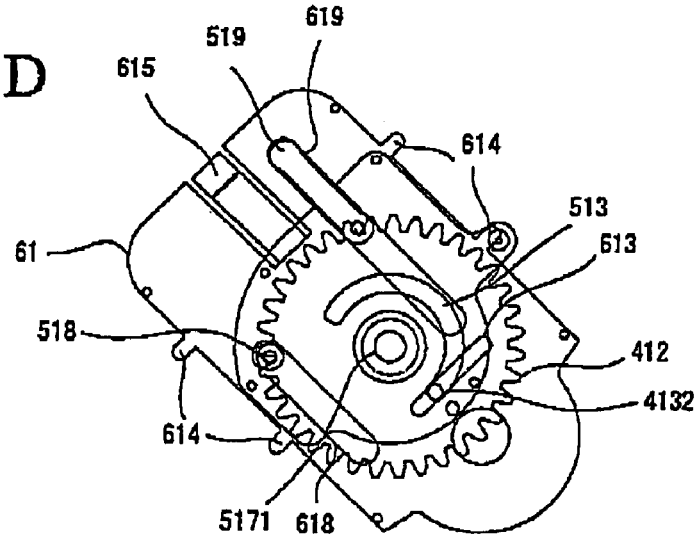

FIG. 13D shows that the rotatable member 41 is further rotated clockwise through 45° from the state shown in FIG. 13C. At that time, the rotatable stage 51 is rotated clockwise through 45° while the tip portion 4132 of the output pin 413 is located at the end of the arcuate groove 513. Furthermore, the slide plate 61 is also rotated clockwise through 45° in cooperation with the rotation of the rotatable stage 51. The movable divisional segment 21 is held at the state shown in FIG. 3.

Figure 13E:
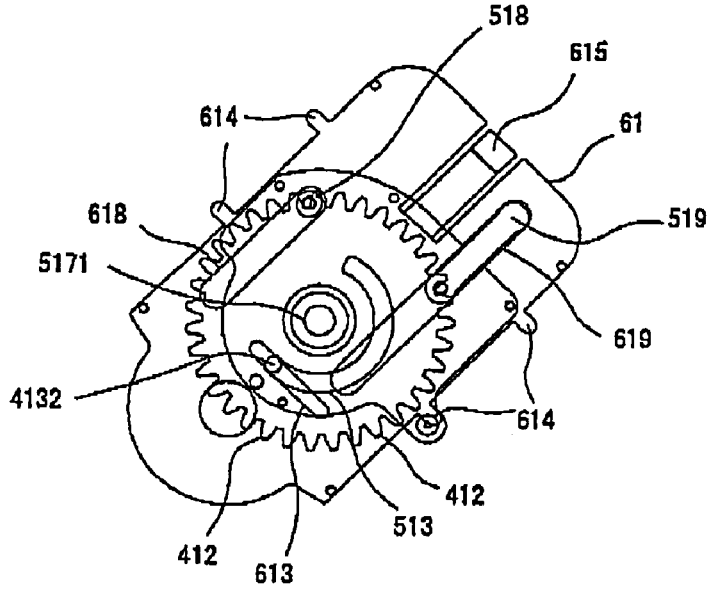

FIG. 13E shows that the rotatable member 41 is further rotated clockwise through 90° from the state shown in FIG. 13D while both of the rotatable stage 51 and the slide plate 61 are rotated as well.

Figure 13F:
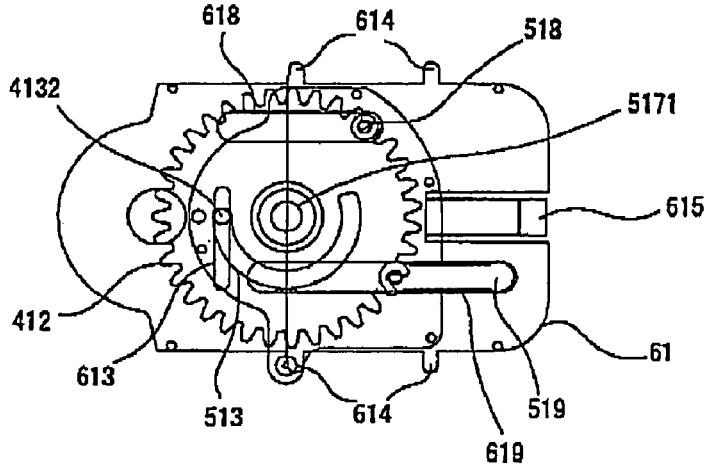

FIG. 13F shows that the rotatable member 41 is further rotated clockwise through 45° from the state shown in FIG. 13E. At that time, the movable divisional segment 21 is held at the state shown in FIG. 5.

As described above, the tip portion 4132 is moved from the initial position to the end of the arcuate groove 513 by the rotation of the rotatable member 41, thereby sliding the slide plate 61 in the predetermined direction. The slide plate 61, the rotatable stage 51, and the rotatable member 41 are rotated in cooperation with one another while the tip portion 4132 is located at the end of the arcuate groove 513. Thus, the movable divisional segment 21 can be rotated by the rotation of the rotatable member 41. Furthermore, movement and rotation of the movable divisional segment can be achieved by a single driving mechanism. Accordingly, it is possible to simplify parts required for a mechanical clock.

In order to return from the state shown in FIG. 13F to the state shown in FIG. 13A, the rotatable member 41 is first rotated in a reverse direction from the state shown in FIG. 13F to the state shown in FIG. 13C. At that time, in accordance with the rotation of the rotatable member 41, the rotatable stage 51 and the slide plate 61 are rotated counterclockwise by the restoring force of the torsion spring 417. After the rotatable stage 51 returns to the initial position shown in FIG.

13C, the rotatable member 41 is rotated from the state shown in FIG. 13C to the state shown in FIG. 13A so that the movable divisional segment 21 returns to the initial position.

Thus, the torsion spring 417 biases the rotatable stage 51 in a direction opposite to the direction of rotation transmitted from the output pin 413 to thereby return the rotatable stage 51 into the initial position. Accordingly, the rotatable stage 51 can readily be returned to the initial position.

Although not shown in FIGS. 13A to 13F, an initial position of the rotatable stage 51 is restricted in a range of rotation because the positional regulation pin 511 is brought into contact with the positional regulation block 71 shown in FIG. 8 in the state shown in FIG. 13C by the biasing force of the torsion spring 417. Thus, it is possible to adjust the amount of rotation of the rotatable stage 51.

The center of rotation of the movable divisional segment in the present embodiment does not accord with its center of gravity. Therefore, an unbalanced load may be produced with respect to the center of rotation when the rotatable stage 51 is at the initial position. For example, in the case of the movable divisional segment 23, the right side of the rotatable stage 51 is heavier than the left side of the rotatable stage 51 with respect to its center of rotation. Specifically, a clockwise moment load around the center of rotation is applied to the movable divisional segment 23 at the initial position.

Under the initial conditions, a counterclockwise biasing force is applied by the torsion spring so as to bring the positional regulation pin 511 into contact with the positional regulation block 71. However, a clockwise moment load is applied to the movable divisional segment 23. Accordingly, if the biasing force is small, then the positional regulation pin 511 cannot be held in contact with the positional regulation block 71. As a result, the positional regulation pin 511 is separated from the positional regulation block 71 by the clockwise moment load. From this point of view, a biasing force of the torsion spring should be larger than a clockwise moment produced by a load of the movable divisional segment 23 in order to hold the positional regulation pin 511 in contact with the positional regulation block 71.

Meanwhile, load moments are produced in all of the movable divisional segments 21 to 24 by the unbalance in the movable divisional segments 21 to 24. Influences of those load moments on contact between the positional regulation pin 511 and the positional regulation block 71 depend upon positions at which the movable divisional segments are disposed. Load moments may have little influence at some positions.

In the present embodiment, the movable divisional segment 23 is most likely to be influenced, and a biasing force of the torsion spring for the movable divisional segment 23 is accordingly increased. However, such a large biasing force is not necessarily required for the other movable divisional segments.

Therefore, if biasing forces of the torsion springs for all the movable divisional segments are set to be equal to a biasing force required for the movable divisional segment 23, then they are excessive for the movable divisional segments other than the movable divisional segment 23.

As the torsion spring produces a larger biasing force, a heavier load is applied to the driving source to rotate the rotatable stage 51 and the slide plate 61. Specifically, if torsion springs having a biasing force sufficient for operation of the movable divisional segment 23 are used for all of the movable divisional segments, then a large electric power is wastefully consumed.

In order to solve this drawback, a torsion spring to suitably produce a required biasing force is attached to each movable divisional segment in the present embodiment. More specifically, for each rotatable stage, an angle formed by the slit 516 formed in the rotatable stage 51 and the slit 916 formed in the fixed shaft 915 is designed to be such an optimal value as to produce an optimal initial biasing force. With this configuration, the electric power consumption can be minimized while the respective movable divisional segments can smoothly be operated.

Although a certain preferred embodiment of the present invention has been shown and described in detail, the present invention is not limited to the illustrated specific embodiment. It should be understood that various changes and modifications may be made therein without departing from the scope of the appended claims.

In the above embodiment, the dial is divided into the four movable divisional segments. However, the present invention is not limited to such an arrangement. For example, the dial may be divided into three movable divisional segments. Alternatively, the dial may be divided into four or more movable divisional segments.

In the above embodiment, the movable divisional segments are rotated after they are moved outward. However, the present invention is not limited to such an arrangement. For example, by modifying shapes of the arcuate grooves, the movable divisional segments can be moved outward while they are rotated.

The present invention are not limited to the specifically disclosed embodiments, but include other embodiments and variations without departing from the scope of the present invention.

The present invention is based on Japanese Patent Application No. 2006-152566 filed May 31, 2006, the entire disclosure of which is hereby incorporated by reference.

What is claimed is:

1. A mechanical timepiece comprising:

a plurality of divisional segments divided in a movable manner;

a driving source operable to produce a driving rotation for moving and rotating said divisional segments;

an ornamental portion to be exposed by outward movement of said divisional segments; and a plurality of driving mechanisms operable to move the corresponding divisional segments and rotate them about their axes so as to change an exposure state of said ornamental portion by using the driving rotation transmitted from said driving source wherein each of said plurality of driving mechanisms includes:

a rotatable member rotating by the said driving source, a rotatable stage rotating in cooperation with said rotatable member rotating beyond a predetermined range, and a slide plate to which the corresponding divisional segment is attached, said slide plate being slidably supported by said rotatable stage, and said slide plate being configured to slide in cooperation with said rotatable member rotating within the predetermined range and to rotate in cooperation with said rotatable member rotating beyond the predetermined range, wherein when said slide plate slides, said slide plate does not rotate, and when said slide plate rotates, said slide plate does not slide.

2. The mechanical timepiece as recited in claim 1, wherein said plurality of divisional segments forms a dial with at least four divisional segments radially divided around a predetermined point, and said driving mechanisms are operable to hold said divisional segments so that an outer shape of said plurality of divisional segments is in a form of a rhombus.

3. The mechanical timepiece as recited in claim 1, wherein said plurality of divisional segments forms a dial with at least three divisional segments radially divided around a predetermined point, and said driving mechanisms are operable to hold said divisional segments so that an outer shape of said plurality of divisional segments is in a form of a windmill.

4. The mechanical timepiece as recited in claim 1, wherein said driving mechanisms are operable to swing the corresponding divisional segments at predetermined positions.

5. The mechanical timepiece as recited in claim 1, wherein said driving mechanisms are operable to move said divisional segments outward to predetermined positions and then rotate them about their axes at the predetermined positions.

6. The mechanical timepiece as recited in claim 1, wherein each of said plurality of driving mechanisms includes:

said rotatable member having an output pin for outputting the driving rotation from said driving source, said output pin being located at a position deviated from a center of rotation of said rotatable member, said rotatable stage having a slide guide portion and an arcuate groove formed along a predetermined range of a path of said output pin engaging with said arcuate groove, said rotatable stage being rotatable concentrically with said rotatable member in cooperation with said output pin moving beyond the predetermined range of the path, and said slide plate to which the corresponding divisional segment is attached, said slide plate including:

an allowance groove for allowing said output pin engaging with said allowance groove to move in a first direction, and a slide guide groove for guiding said slide plate in a second direction different than the first direction with respect to said rotatable stage having said slide guide portion engaging with said slide guide groove, said slide plate being configured to slide in the second direction in cooperation with said output pin moving within the predetermined range of the path and to rotate in cooperation with rotation of said rotatable stage.

7. The mechanical timepiece as recited in claim 6, wherein each of said plurality of driving mechanisms further includes a biasing member configured to apply a biasing force to said rotatable stage in a direction opposite to a direction of rotation transmitted from said output pin.

8. The mechanical timepiece as recited in claim 7, wherein the biasing force applied to said rotatable stage by said biasing member is set at an optimum value for each rotatable stage.

9. The mechanical timepiece as recited in claim 6, wherein each of said plurality of driving mechanisms further includes a positional regulator for regulating an initial position of said rotatable stage in a range of rotation.

* * * * *